US007878497B2

(12) United States Patent
Adachi

(10) Patent No.: US 7,878,497 B2
(45) Date of Patent: Feb. 1, 2011

(54) IMAGE FORMING APPARATUS AND SHEET INSERTING DEVICE

(75) Inventor: Seiichiro Adachi, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 170 days.

(21) Appl. No.: 12/368,628

(22) Filed: Feb. 10, 2009

(65) Prior Publication Data

US 2009/0206540 A1 Aug. 20, 2009

(30) Foreign Application Priority Data

Feb. 15, 2008 (JP) ..... 2008-035058

(51) Int. Cl.
*B65H 37/04* (2006.01)

(52) U.S. Cl. ..... 270/58.23; 270/58.09; 399/410

(58) Field of Classification Search ..... 270/58.08, 270/58.09, 58.1, 58.23; 399/410
See application file for complete search history.

(56) References Cited

U.S. PATENT DOCUMENTS 5,700,002 A 12/1997 Kato et al. ..... 270/58.12
6,276,677 B1 8/2001 Hommochi et al. ..... 270/32
6,371,471 B1 * 4/2002 Fukazu et al. ..... 270/58.09
6,442,368 B1 * 8/2002 Ohtsuka et al. ..... 399/382
6,976,672 B2 * 12/2005 Kawata ..... 271/9.11
7,017,903 B2 * 3/2006 Fujii et al. ..... 271/298
7,146,011 B2 * 12/2006 Yang et al. ..... 381/77
7,419,152 B2 9/2008 Adachi ..... 271/97
7,588,241 B2 * 9/2009 Murata et al. ..... 270/58.11
2009/0039585 A1 * 2/2009 Hayashi et al. ..... 270/58.08

FOREIGN PATENT DOCUMENTS

JP 2001-26338 A 1/2001

* cited by examiner

*Primary Examiner*—Patrick Mackey
(74) *Attorney, Agent, or Firm*—Fitzpatrick, Cella, Harper & Scinto

(57) ABSTRACT

The image forming apparatus including a sheet conveying path which is arranged at the sheet inserting device and which conveys the sheets on which the images are formed at the image forming apparatus main body and the insertion sheet to the post-processing device and a sheet conveying portion which is arranged at the sheet conveying path and which conveys the sheets being capable of accelerating and decelerating is controlled to accelerate sheet conveying speed of the sheets from the image forming apparatus main body from a predetermined conveying speed at the sheet conveying path, to insert the insertion sheet so as to follow a preceding sheet which is accelerated, and to convey the sheets from the image forming apparatus main body and the insertion sheet to the post-processing device after being decelerated to the predetermined conveying speed.

12 Claims, 6 Drawing Sheets

IMAGE FORMING APPARATUS AND SHEET INSERTING DEVICE

BACKGROUND OF THE INVENTION

1. Field of the Invention

The present invention relates to an image forming apparatus. More particularly, the present invention relates to an image forming apparatus including a sheet inserting device which inserts an insertion sheet between sheets to which images are formed at an image forming apparatus main body.

2. Description of the Related Art

Conventionally, with an image forming apparatus such as a copier and a printer which includes an image forming portion, the image forming is performed easier when the sheet conveying speed at the image forming portion is slower. Therefore, the sheet conveying speed is preferred to be slow in order to obtain stable images. In addition, the cost becomes low in the case that the sheet conveying speed is set to be slow.

Further, when the sheets are continuously separated and fed by a sheet separating/feeding portion, the intervals between the sheets need to be enlarged in order to reliably separate and feed the sheets one by one. For example, with a retard separating/feeding portion having a pickup roller and a retard roller, in order to manage a failure of the sheet feeding with a single pickup operation, there needs to be a predetermined interval between feeding a sheet and feeding the next sheet for retrial.

Further, with an air separating/feeding portion which performs separation/feed by adsorbing a sheet to a belt with air, a predetermined interval needs to be set for adsorbing the sheet to the belt. As described above, the sheet conveying speed is preferred to be slow in order to obtain stable images at low cost. In addition, in order to reliably separate and feed the sheets one by one continuously, the sheets need to be conveyed at predetermined intervals.

On the other hand, with a conventional image forming apparatus, there is a case that high productivity is required in addition to the image forming and the sheet separating/feeding reliably at low cost. In order to meet such requirement, there is an image forming apparatus which accelerates sheets after performing separation/feed in a sheet separation period for the stable separation/feed and decelerates the sheets just before the image forming portion.

By structuring as described above, the sheet conveying intervals at the image forming portion can be shortened and the sheet conveying speed can be slowed at the image forming portion. Therefore, stable image forming at low cost and high productivity can be achieved.

Further, a conventional image forming apparatus includes a post-processing device which performs a post-process to the sheets on which images are formed and the sheets are transferred to the post-processing device after images are formed. Then, the post-processing device performs a process of bookbinding etc. to bind a sheet bundle. With such post-processing device, the sheet conveying speed is also slowed to synchronize to the image forming speed (the sheet conveying speed) of the image forming apparatus in order to perform the process reliably at low cost.

Furthermore, a sheet inserting device is arranged between a conventional image forming apparatus and a post-processing device. The sheet inserting device inserts a sheet which does not pass through the image forming apparatus or a sheet on which an image is previously formed (hereinafter, collectively called the insertion sheet) between the sheets which are sequentially discharged from the image forming apparatus.

In the case that the insertion sheet from the sheet inserting device is inserted to the sheet bundle as described above, the image forming apparatus forms the image so that the sheet is conveyed with spacing of the interval for the insertion sheet. The following is an example of when four sheets are continuously discharged from the image forming apparatus at time intervals of one second between the top ends of the sheets. When an insertion sheet is inserted between the third sheet and the fourth sheet, the image forming apparatus forms images at constant interval of one sheet per second from the first sheet until the third sheet.

However, the image forming timing is changed when an image is formed on the fourth sheet. Namely, the image forming is performed so that the time interval from the top end of the third sheet to the top end of the fourth sheet is to be two seconds. Then, when these four sheets pass through the sheet inserting device, one insertion sheet is inserted between the third sheet and the fourth sheet. Accordingly, when the five sheets are discharged from the sheet inserting device, namely, when conveyed to the post-processing device, the five sheets are discharged in five seconds at time intervals of one second.

Here, when inserting the insertion sheet at the sheet inserting device, the speed of the insertion sheet needs to be approximately equal to that of the sheet conveyed from the image forming apparatus. However, as described above, the sheets are conveyed from the image forming apparatus at low sheet conveying speed with narrow conveying intervals (inter-sheet distance). Therefore, when inserting the insertion sheets, the sheet inserting device inserts the insertion sheets at the low sheet conveying speed with the narrow conveying intervals.

Incidentally, even with the sheet inserting device, predetermined time is needed for stable separation/feed of the sheets, as described above. Therefore, the intervals of the insertion sheets become wide and the sheet conveying speed of the insertion sheets need to be set fast accordingly.

Consequently, when the insertion sheets are continuously inserted between the sheets conveyed from the image forming apparatus, the slow sheet conveying speed and the narrow inter-sheet distance which are the same as those of the sheets conveyed from the image forming apparatus cannot be achieved with the sheet inserting device. Therefore, with the conventional sheet inserting device, the sheet conveying speed of the sheets conveyed from the image forming apparatus is set to be fast or the inter-sheet distance is set to be wide (see Japanese Patent Application Laid-open No. 2001-26338).

With such a conventional image forming apparatus, when the sheet conveying speed at the sheet inserting device is set to be fast, the sheet conveying speed of discharging from the image forming apparatus main body differs from the sheet conveying speed of discharging from the sheet inserting device toward the post-processing device. Accordingly, the conveying speed of sheet receiving by the post-processing device has to be changed between the case that the post-processing device receives the discharged sheets directly from the image forming apparatus main body without disposing the sheet inserting device and the case that the post-processing device receives the discharged sheets from the disposed sheet inserting device.

Here, in the case that the sheets are discharged from the image forming apparatus main body directly to the post-processing device, a signal which indicates that the sheets are discharged is outputted from the image forming apparatus main body to the post-processing device. Further, in the case that the sheet inserting device is connected to the image forming apparatus main body, a signal which indicates that the sheet inserting device is connected is outputted from the image forming apparatus main body to the post-processing device.

Then, when the signal which indicates that the sheets are discharged from the image forming apparatus main body directly to the post-processing device is received or when the signal which indicates that the sheet inserting device is connected is received, the post-processing device first determines whether the sheet is from the image forming apparatus main body or from the sheet inserting device. Then, the post-processing device changes the sheet conveying speed of the transferring in accordance with the determination. As a result, the control becomes complicated and the transferring between the devices becomes unstable. Accordingly, there is a problem that conveyance jamming occurs.

On the other hand, with the conventional image forming apparatus, when the sheet conveyance intervals are widened at the sheet inserting device without changing the sheet conveying speed, the productivity per unit time is decreased due to the widening. Accordingly, there is a problem that the required high productivity cannot be achieved.

The present invention provides an image forming apparatus which can stably insert an insertion sheet without decreasing the productivity.

SUMMARY OF THE INVENTION

An image forming apparatus according to the present invention includes an image forming apparatus main body, a sheet inserting device which is arranged to be detachable from the image forming apparatus main body and which inserts an insertion sheet between sheets on which images are formed, a post-processing device which performs a post-process to the sheets on which the images are formed at the image forming apparatus main body and the insertion sheet, a sheet conveying path which is arranged at the sheet inserting device and which conveys the sheets on which the images are formed at the image forming apparatus main body and the insertion sheet to the post-processing device, a sheet conveying portion which is arranged at the sheet conveying path and which conveys the sheets being capable of accelerating and decelerating, and a control portion which controls operation of the sheet conveying portion. The control portion performs the control of accelerating sheet conveying speed of the sheets from the image forming apparatus main body from a predetermined conveying speed at the sheet conveying path, inserting the insertion sheet so as to follow a preceding sheet which is accelerated, and conveying the sheets from the image forming apparatus main body and the insertion sheet to the post-processing device after being decelerated to the predetermined conveying speed.

With the present invention, the sheet conveying speed of the sheet from the image forming apparatus main body is accelerated before the insertion sheet is inserted. Further, the sheet conveying speed of the sheet from the image forming apparatus main body and the insertion sheet is decelerated before the sheet from the image forming apparatus main body and the insertion sheet respectively arrive at the post-processing device. In this manner, the insertion sheet can be stably inserted without decreasing the productivity.

Further features of the present invention will become apparent from the following description of exemplary embodiments with reference to the attached drawings.

DESCRIPTION OF THE EMBODIMENTS

In the following, an embodiment of the present invention is described in detail with reference to the drawings.

Figure 1:
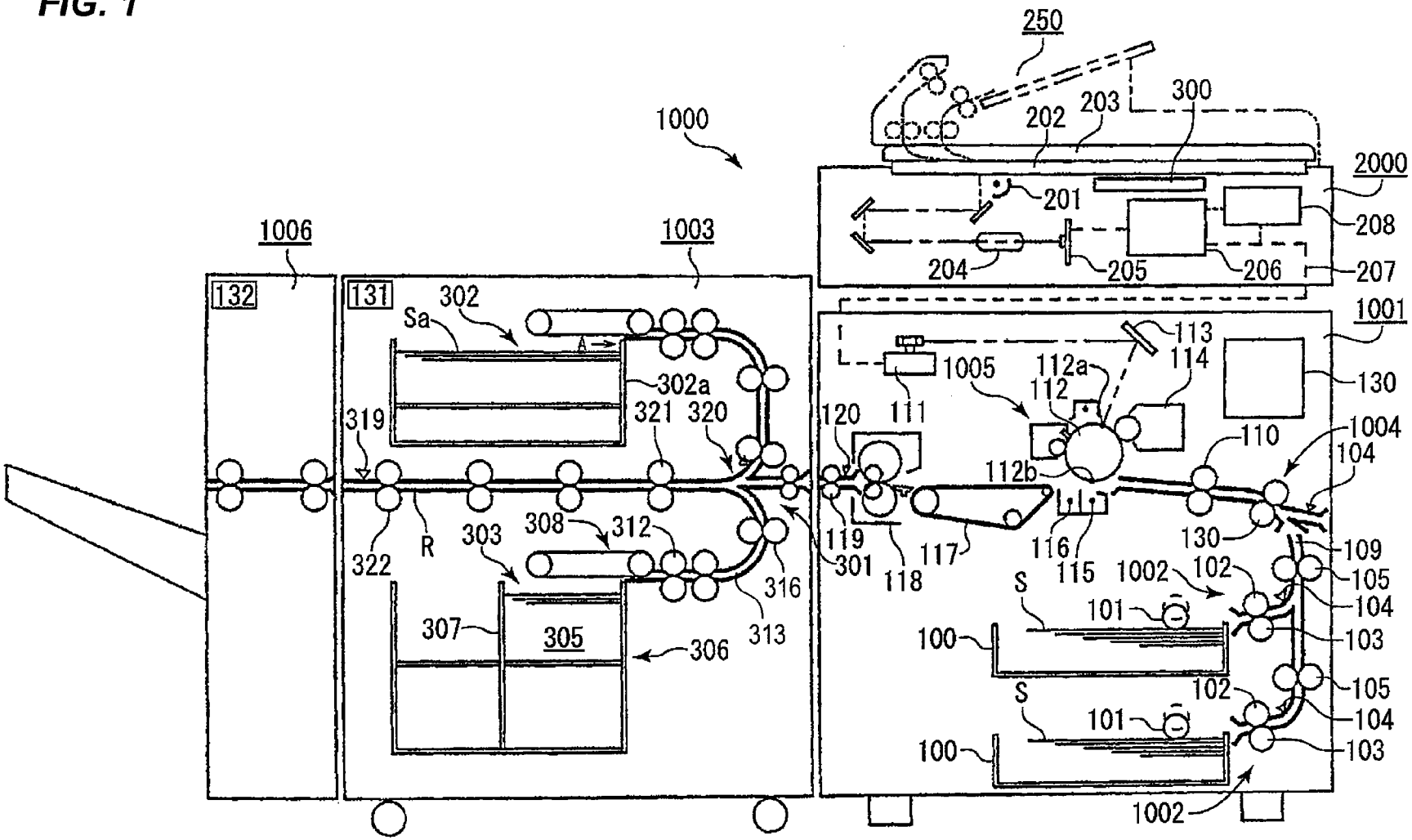
FIG. 1 is a diagram which illustrates the structure of a printer as an example of an image forming apparatus according to an embodiment of the present invention.

FIG. 1 is a diagram which illustrates the structure of a printer as an example of an image forming apparatus according to an embodiment of the present invention.

In FIG. 1, a printer 1000 includes a printer main body 1001 which is an image forming apparatus main body and a scanner 2000 which is arranged on the upper face of the printer main body 1001. Further, an inserter 1003 which is a sheet inserting device and a finisher 1006 which is a post-processing device to perform a post-process such as stapling, aligning and bookbinding to the sheets fed from the inserter 1003 and the printer main body 1001 are arranged at a side of the printer main body 1001. The inserter 1003 which is a sheet inserting device is detachably arranged to the image forming apparatus. Further, the print operation can be performed in the state that the inserter 1003 is detached from the image forming apparatus and the printer main body 1001 and the finisher 1006 are directly connected.

The scanner 2000 reads an original. The scanner 2000 includes a scanning optical source 201, a platen glass 202, an original pressing plate 203 which opens and closes, a lens 204, a light receiving element (photoelectric conversion) 205 and an image processing portion 206. Furthermore, the scanner 2000 includes a memory portion 208 which stores image processing signals processed by the image processing portion 206.

The original, not illustrated in the drawings, which is placed on the platen glass 202 is read by irradiating light with the scanning optical source 201. With processing by the image processing portion 206, the image of the read original is converted into an electrical signal 207 which is electrically coded and transmitted to a laser scanner 111 which is image producing unit.

Here, the coded image information which is processed by the image processing portion 206 can be temporally stored at the memory portion 208 and can be transmitted to the laser scanner 111 as needed in accordance with a signal from a controller 130 which is described later.

The printer main body 1001 includes an image forming portion 1005, a sheet feeding device 1002 and a sheet conveying device 1004 which conveys sheets S fed by the sheet feeding device 1002 to the image forming portion 1005.

Here, the sheet feeding device 1002 includes a cassette 100, a pickup roller 101 and a separating portion which is structured by a feed roller 102 and a retard roller 103. Then, the sheets S in the cassette 100 are separated and fed one by one with the operation of the pickup roller 101 which lifts and lowers/rotates at predetermined timing and the operation of the separating portion.

The sheet conveying device 1004 includes a pair of vertical pass rollers 105 and a pair of resist rollers 110. The sheets S fed from the sheet feeding device 1002 are passed through a sheet conveying path 109 by the pair of vertical pass rollers 105. Then, the sheets S are conveyed to the image forming portion 1005 while skew feeding is corrected by the pair of resist rollers 110.

The image forming portion 1005 forms an image on a sheet by an electrophotograph method. The image forming portion 1005 includes a photoconductive drum 112 which is an image bearing member, the laser scanner 111 which is image writing unit, a developing unit 114, a transfer charger 115 and a separating charger 116.

When forming an image, firstly, laser light from the laser scanner 111 is reflected by a mirror 113 and irradiated to an exposure position 112*a* on the photoconductive drum 112 which rotates in the clockwise direction. Accordingly, a latent image is formed on the photoconductive drum 112. Further, the latent image which is formed on the photoconductive drum 112 is made to be apparent as a toner image by the developing unit 114.

Next, the apparent toner image on the photoconductive drum 112 is transferred to the sheet S at the transfer portion 112*b* by the transfer charger 115. Further, the sheet S to which the toner image is transferred is electrostatically separated from the photoconductive drum 112 by the separating charger 116. Then, the toner image is fixed after the sheet S is conveyed to a fixing device 118 by a conveying belt 117 and the sheet S is discharged by a discharge roller 119 thereafter.

Here, in the present embodiment, the printer main body 1001 and the scanner 2000 are arranged separately. However, there is a case that the printer main body 1001 and the scanner 2000 are arranged integrally. In either case that the printer main body 1001 and the scanner 2000 are arranged separately or integrally, the apparatus functions as a copier when the processed signal of the scanner 2000 is inputted to the laser scanner 111. The apparatus functions as a facsimile when a transmitting signal of a facsimile is inputted. Furthermore, the apparatus also functions as a printer when an output signal of a personal computer is inputted.

On the contrary, the apparatus functions as a facsimile when the processed signal of the image processing portion 206 of the scanner 2000 is transmitted to another facsimile. Here, when an automatic original feeding apparatus 250 is attached as illustrated by a two-dot chain line to the scanner 2000 to replace the original pressing plate 203, the original can be read automatically.

In FIG. 1, a controller 130 controls the printer main body 1001. The controller (hereinafter, called the main body controller) 130 exchanges information with a control portion 131 of the inserter 1003 and a control portion 132 of the finisher 1006.

Further, in FIG. 1, a discharge sensor 120 is arranged at a conveying path between the fixing device 118 and the discharge roller 119. The main body controller 130 detects the passing of the sheet S which is discharged from the printer main body 1001 with the detection signal of the discharge sensor 120.

The sheet S to which the toner image is fixed and which is discharged by the discharge roller 119 is introduced to a sheet conveying portion 301 arranged at the inserter 1003 which inserts a sheet such as a front cover and an interleaf in front, back or inside of a sheet bundle to which images are formed.

The sheet conveying portion 301 includes a conveying path R which is a sheet conveying path to convey the sheet S discharged from the printer main body 1001 to the finisher 1006, an upper sheet feeding portion 302 and a lower sheet feeding portion 303.

The upper sheet feeding portion 302 and the lower sheet feeding portion 303 structure a sheet delivering portion which inserts the insertion sheet between the sheets introduced to the conveying path R from the image forming portion 1005. Here, a sheet to which an image is not formed, a sheet to which an image is previously formed and a sheet which should not pass through the printer main body 1001, which are to be used for an interleaf, a front cover, a back cover, a partition sheet and the like of a sheet bundle, can be adopted as the insertion sheet which is to be inserted by the upper sheet feeding portion 302 and the lower sheet feeding portion 303.

The lower sheet feeding portion 303 includes a sheet accommodating portion 306 which is an insertion sheet accommodating portion to accommodate a sheet bundle 305 and a sheet separating/feeding portion 308 which is an insertion sheet feeding portion to separate and feed the sheet accommodated in the sheet accommodating portion 306. Here, the lower sheet feeding portion 303 adopts an air feeding mechanism in order to perform stable separating and feeding against a various kinds of sheets.

Figure 2:
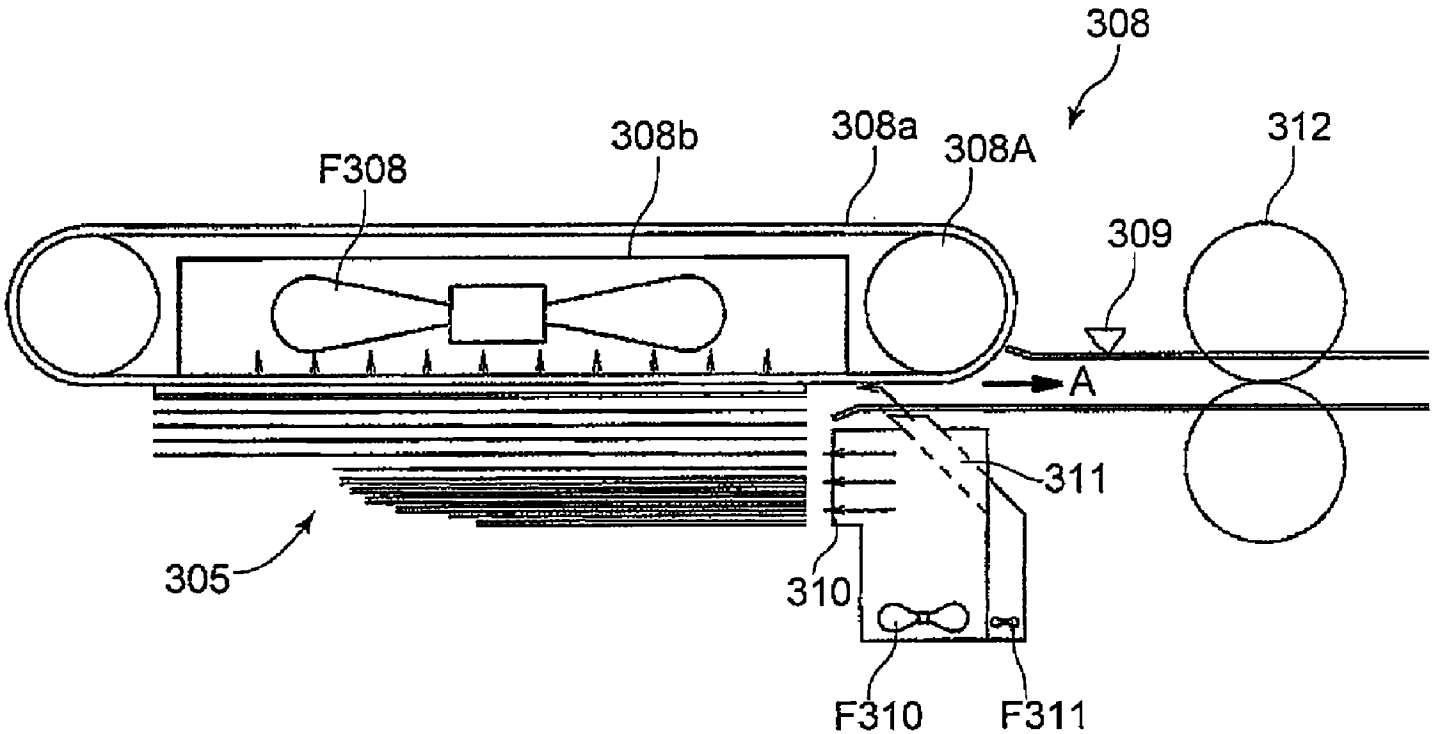
FIG. 2 is a diagram which illustrates the structure of a sheet separating/feeding portion which is arranged at a sheet conveying portion of an inserter of the printer.

Next, the sheet separating/feeding portion 308 which adopts the air feeding mechanism is described with reference to FIG. 2. FIG. 2 illustrates a loosening fan F310, a loosening nozzle 310, a separating fan F311, a separating nozzle 311, an adsorbing/conveying belt 308*a*, an adsorbing duct 308*b* and a sucking fan F308. Here, the adsorbing/conveying belt 308*a* is driven by a driving roller 308A which is driven in rotation by a motor (not illustrated in drawings).

When a sheet is separated and fed at the sheet separating/feeding portion 308, the loosening fan F310 and the separating fan F311 rotate as a preparatory operation for feeding and air blows toward the upper portion of the sheet bundle 305 respectively from the loosening nozzle 310 and the separating nozzle 311. As a result, a few sheets of the sheet bundle 305 at the upper portion are loosened and lifted.

Next, when a feeding start signal is transmitted from the control portion (hereinafter, called the inserter control portion) 131 of the inserter 1003, the sucking fan F308 rotates and negative pressure is generated in the adsorbing duct 308*b*. Here, since a large number of holes are formed at the adsorbing/conveying belt 308*a*, the sucking of a sheet is started with the negative pressure via the adsorbing/conveying belt 308*a*. After a sucking time t1, a single sheet which positions at the top of the sheet bundle 305 is stuck to the adsorbing/conveying belt 308*a*. Then, after a predetermined time, the adsorbing/conveying belt 308*a* is started to rotate by the driving roller 308A in the state that the sheet is being stuck to the adsorbing/conveying belt 308*a*. In this manner, the sheet is conveyed in the direction of arrow A.

Next, when the top end of the sheet departs from the adsorbing duct 308*b*, the top end of the sheet is released from the sucking force of the sucking fan F308 and transferred to a pair of extracting rollers 312 leaving from the adsorbing/conveying belt 308*a*. When the top end of the sheet arrives at the pair of extracting rollers 312, the sheet is released from the negative pressure of the sucking fan F308 and conveyed at the conveying speed V2 by the conveying force of the pair of extracting rollers 312.

Next, after the rear end of the sheet departs from the adsorbing/conveying belt 308*a*, the above feeding operation is started when the feeding start signal is transmitted again from the inserter control portion 131. Accordingly, the next sheet is separated and fed.

Then, the sheet which is separated one by one by the sheet separating/feeding portion 308 is merged with the sheet which is discharged from the printer main body 1001 at a merging point 320 arranged at the upstream side of the sheet conveying direction of the conveying path R as illustrated in FIG. 1 and conveyed to the finisher 1006.

Here, the upper sheet feeding portion 302 is structured similarly to the lower sheet feeding portion 303. Accordingly, desired insertion sheets are sequentially inserted from the upper sheet feeding portion 302 and the lower sheet feeding portion 303 between the sheets which are discharged from the printer main body 1001.

When the sheets are conveyed from the inserter 1003, the finisher 1006 forms the sheet bundle by sequentially piling and aligning the sheets and performs a variety of processes such as stapling with a stapler (not illustrated in the drawings) and piling without stapling. Here, the processes are performed in an appropriate condition by the control portion (hereinafter, called the finisher control portion) 132 of the finisher 1006 in accordance with the information such as size of the sheets, quantity and types which are inputted by the main body controller 130.

Next, the sheet inserting operation at the inserter 1003 which has the above structure is described. In the following, an example is described to form a sheet bundle by preparing ten sheets of main text with the printer 1001, attaching a front cover and a back cover which are previously printed, and inserting a partition sheet between the fifth sheet and the sixth sheet at the inserter 1003.

The sheets S for preparing the main text are accommodated in the cassette 100 of the printer main body 1001. Further, the partition sheets Sa are accommodated in the sheet accommodating portion 302*a* of the upper sheet feeding portion 302 of the inserter 1003 as illustrated in FIG. 1. Furthermore, the sheet bundle 305 in which the previously printed front cover and back cover are alternately piled is accommodated in the sheet accommodating portion 306 of the lower sheet feeding portion 303.

When a signal which directs bookbinding of the sheet bundle is inputted from an operating portion (not illustrated in the drawings) or a far located computer, the main body controller 130 transmits the information regarding the bookbinding of the sheet bundle such as number of the sheets and the sheet inserting timing to the inserter control portion 131. Similarly, the information regarding the bookbinding of the sheet bundle is transmitted to the finisher control portion 132. Accordingly, the inserter 1003 and the finisher 1006 start the preparation for operation.

Figure 3:
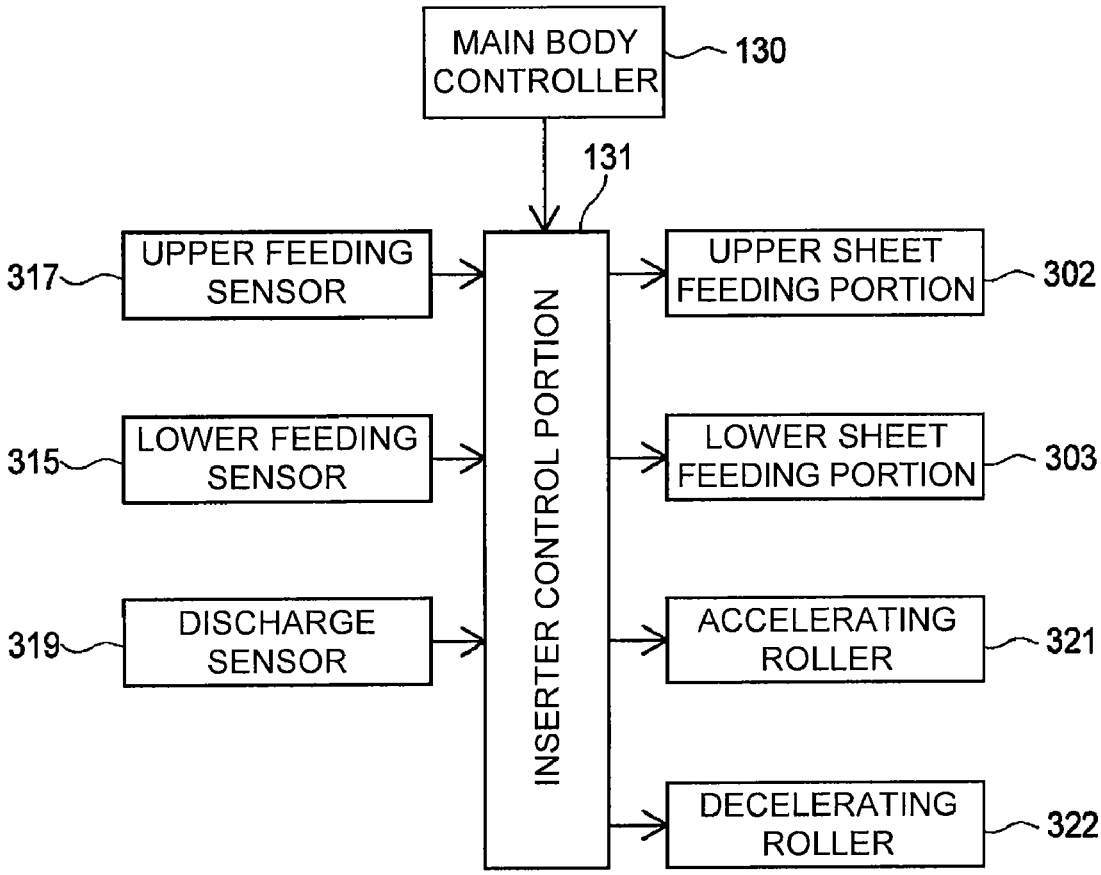
FIG. 3 is a block diagram of an inserter control portion which is arranged at the inserter.

Here, as illustrated in FIG. 3, the inserter control portion 131 controls the driving of the upper sheet feeding portion 302 and the lower sheet feeding portion 303. When the information regarding the bookbinding of the sheet bundle is received from the main body controller 130, the inserter control portion 131 drives the upper sheet feeding portion 302 and the lower sheet feeding portion 303 as the preparation for operation. As described later, the inserter control portion 131 controls revolution speed (sheet conveying speed) of an accelerating roller 321 which is arranged at the conveying path R and a decelerating roller 322 which is arranged at the downstream side of the sheet conveying direction of the accelerating roller 321.

Figure 4:
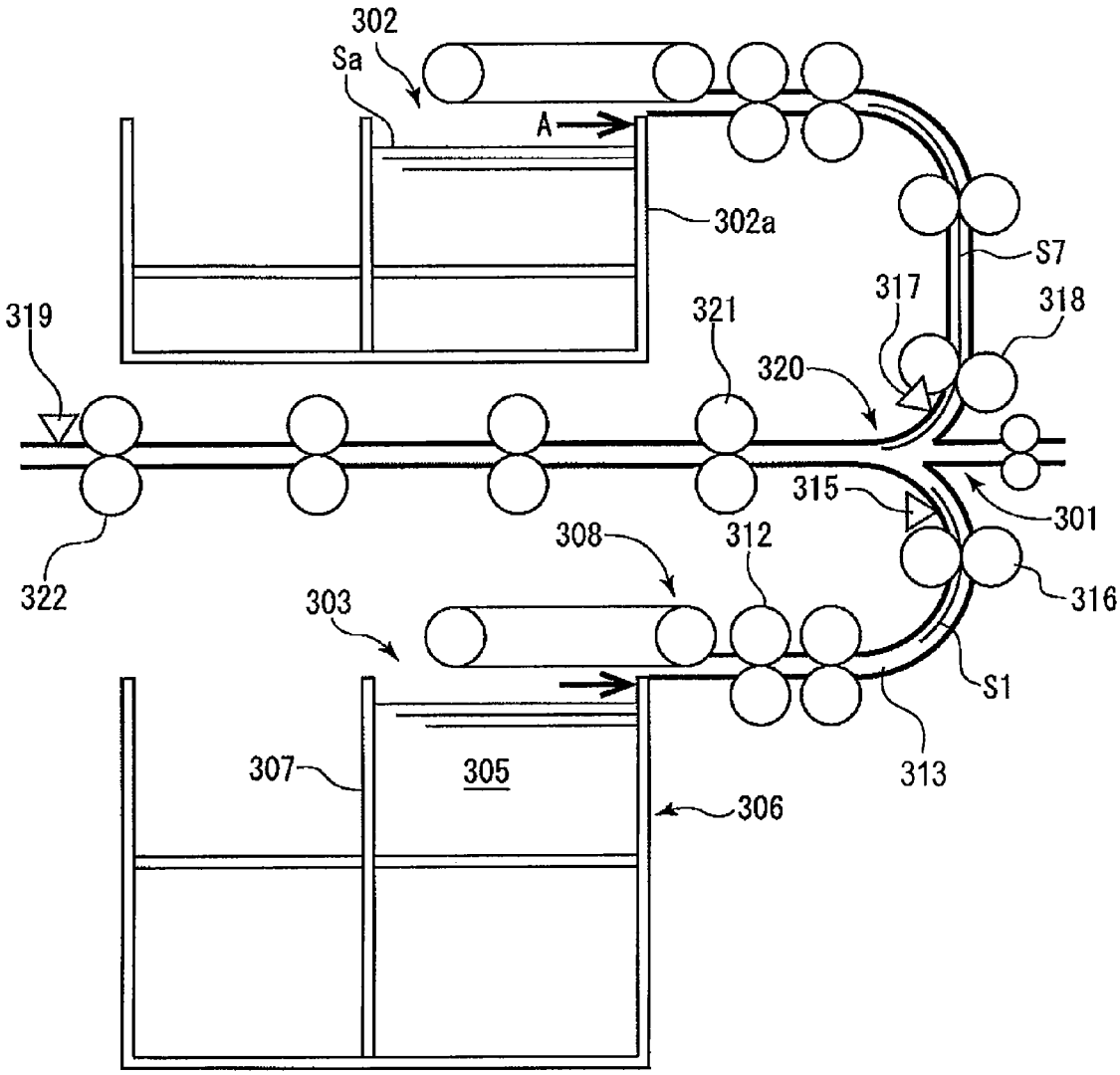
FIG. 4 is a diagram which illustrates a sheet inserting operation of the inserter.

With this structure, the partition sheet S7 is separated and fed from the upper sheet feeding portion 302 and passes through an upper feeding sensor 317 as illustrated in FIG. 4. Then, based on the detection signal of the upper feeding sensor 317, the inserter control portion 131 controls the driving of the upper sheet feeding portion 302 and keeps the partition sheet S7 waiting before arriving at the merging point 320.

Further, the front cover S1 is separated and fed from the lower sheet feeding portion 303 and passes through a lower feeding sensor 315. Then, based on the detection signal of the lower feeding sensor 315, the inserter control portion 131 controls the driving of the lower sheet feeding portion 303 and keeps the front cover S1 waiting at an insertion sheet conveying path 313 before arriving at the merging point 320. Here, predetermined preparation is performed also at the finisher 1006 by the finisher control portion 132 based on the information regarding the bookbinding of the sheet bundle from the main body controller 130.

After the preparations for operation of the inserter 1003 and the finisher 1006 are completed, the inserter control portion 132 drives a conveying roller 316 which is arranged at the lower sheet feeding portion 303 as illustrated in FIG. 4. Accordingly, the front cover S1 waiting at the position before the merging point 320 starts moving prior to the discharging of the sheet S2 from the printer main body 1001. The front cover S1 starts to be conveyed at the sheet conveying speed V1 from the waiting position.

Then, the front cover S1 arrives at the accelerating roller 321 which is a first sheet conveying member located at the downstream side of the sheet conveying direction of the merging point 320 in the inserter 1003. At that time, the sheet conveying speed of the accelerating roller 321 is set at V1 and the front cover S1 is conveyed at the sheet conveying speed V1.

When the rear end of the front cover S1 departs from the accelerating roller 321, the sheet conveying speed of the accelerating roller 321 is decelerated to V0 which is a first sheet conveying speed of entering of the sheet to the conveying path R from the image forming portion 1005. In other word, when the rear end of the front cover S1 departs from the accelerating roller 321, the sheet conveying speed of the accelerating roller 321 is decelerated to the transferring speed between the printer 1001 and the inserter 1003, namely, the discharging speed V0 of the printer 1001 so as to prepare for the transferring.

Figure 5A:
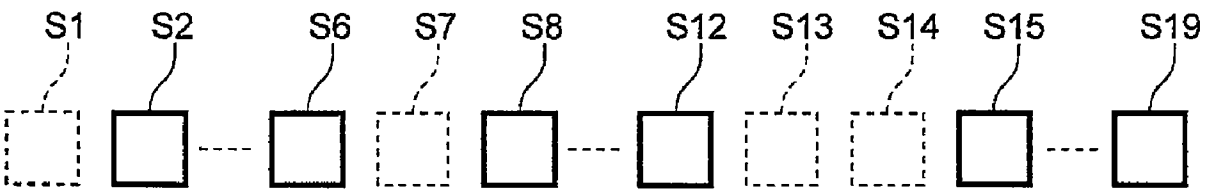
FIGS. 5A and 5B are diagrams which illustrates an example of the sheet inserting operation of the inserter.

On the other hand, in the printer main body 1001, the sheets S2 through S6 for the main text are separated and fed at the same intervals as illustrated in FIG. 5A. Then, after the interval for inserting the partition sheet S7 is spaced, namely, after the interval for conveying one sheet is spaced, the sheets S8 through S12 are separated and fed. Further, after the interval for inserting two sheets of the back cover S13 and the next front cover S14 is spaced, the second main text sheets S15 through S19 are separated and fed.

The image forming is performed in the state that the intervals for the insertion sheets S1, S7, S13 and S14 are spaced. The sheets S2 through S6 on which images are formed sequentially pass through the discharge sensor 120. Then, the main text sheet S2 which firstly passes through the discharge sensor 120 arrives at the accelerating roller 321 which is capable of conveying at any sheet conveying speed of V0 and V1 as the second sheet conveying speed being higher than V0 and which is kept at the sheet conveying speed of V0. Further, when the rear end of the sheet is determined to be discharged from the discharge roller 119 thereafter, the inserter control portion 131 accelerates the sheet conveying speed of the accelerating roller 321 from V0 to V1.

Here, as described above, the sheet conveying speed V0 of the accelerating roller 321 at the time of receiving the sheet is the same as the sheet conveying speed (the image forming speed) V0 of the printer main body 1001. In this manner, by setting the sheet conveying speed of the accelerating roller 321 at the time of receiving the sheet to be the same as the conveying speed of the sheet from the printer main body 1001, the receiving of the sheet from the printer main body 1001 is stably performed. Accordingly, the occurrence of jamming can be prevented.

Figure 5B:
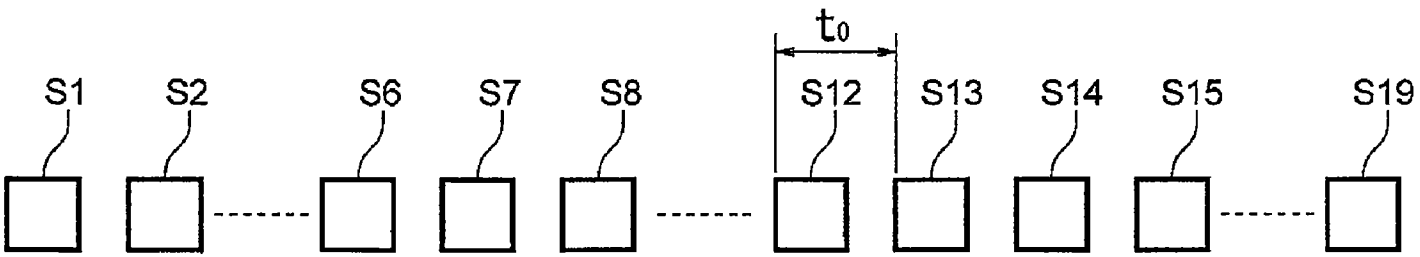

The front cover S1 is conveyed at the sheet conveying speed V1, then, the sheets S2 through S6 are conveyed as being accelerated in the inserter 1003 by the accelerating roller 321. Here, the acceleration of the sheet conveying speed is completed before the rear end of the sheet arrives at the merging point 320. Therefore, the sheets S2 through S6 are conveyed at the sheet conveying speed V1 following the front cover S1 which is conveyed at the sheet conveying speed V1. As illustrated in FIG. 5B, the sheets S2 through S6 pass through the conveying path R in the condition that the intervals are widened after passing though the merging point 320.

Then, when the rear end of the sheet S6 passed through the merging point 320, the inserter control portion 131 drives a conveying roller 318 which is arranged at the upper sheet feeding portion 302 as illustrated in FIG. 4. Accordingly, the partition sheet S7 which is separated and fed from the upper sheet feeding portion 302 and which is waiting at the position before the merging point 320 is conveyed at the sheet conveying speed V1. As a result, as illustrated in FIG. 5B, the partition sheet S7 is inserted between the sheet S6 which is conveyed at the sheet conveying speed V1 and the sheet S8 which is sequentially discharged from the printer main body 1001.

As described above, the sheet which passes through the merging point 320 is conveyed at the sheet conveying speed V1. Then, the front cover S1 which is positioned at the top of the conveyed sheet bundle passes through the discharge sensor 319 which is arranged at the downstream side of the conveying direction of the conveying path R.

Based on the detection signal of the discharge sensor 319, the inserter control portion 131 decelerates the sheet conveying speed of the decelerating roller 322 of FIG. 4 from V1 to V0, the decelerating roller 322 being a second sheet conveying member which is capable of conveying at any sheet conveying speed of V0 and V1. Namely, the sheet conveying speed is decelerated from V1 to V0 which is the sheet processing speed of the finisher 1006 being the same as the transferring speed between the printer 1001 and the inserter 1003. Accordingly, the transferring of the sheets discharged from the inserter 1003 to the finisher 1006 can be stably performed and the occurrence of jamming can be prevented.

Then, the sheets S8 through S12 are conveyed at the sheet conveying speed V1. After the sheet S12 passes through the merging point 320, the inserter control portion 131 drives the conveying roller 316 which is arranged at the lower sheet feeding portion 303 as illustrated in FIG. 4. After being separated and fed by the lower sheet feeding portion 303, the back cover S13 is kept waiting at the position before the merging point 320 by that time.

Then, the back cover S13 which is separated and fed by the lower sheet feeding portion 303 and waiting at the position before the merging point 320 starts to be conveyed at the sheet conveying speed V1. As illustrated in FIG. 5B, the back cover S13 is inserted between the sheet S12 which is conveyed at the sheet conveying speed V1 and the sheet S15 which is sequentially discharged from the printer main body 1001. Then, as illustrated in FIG. 5B, the front cover S14 is conveyed thereafter at the sheet conveying speed V1 by the lower sheet feeding portion 303 and inserted between the back cover S13 and the sheet S15.

Figure 6:
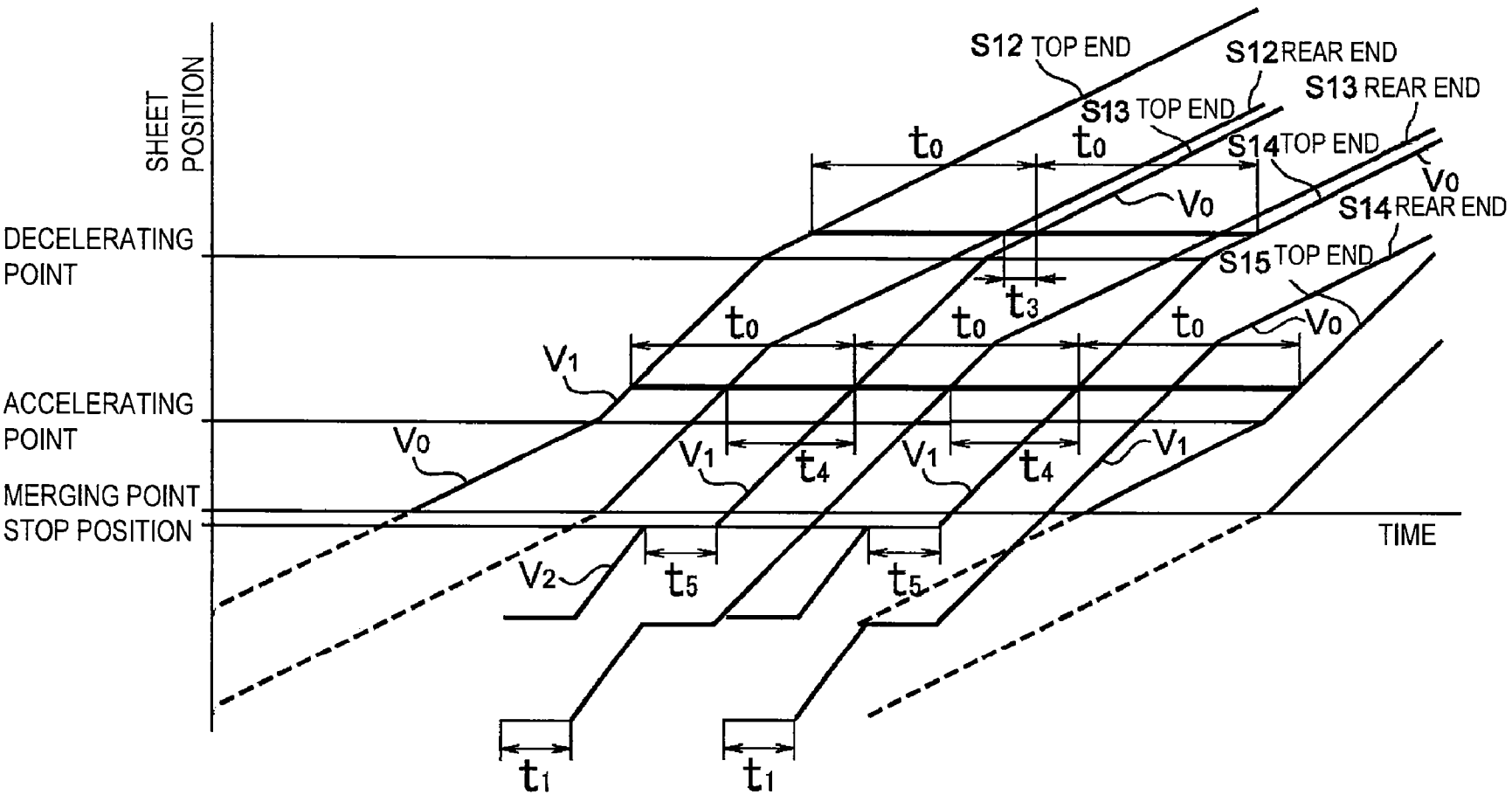
FIG. 6 is a chart which illustrates the relation among the time of sheet conveying of the inserter, the sheet position and the sheet conveying speed.

FIG. 6 is a chart which illustrates the relation among the time, the sheet position and the sheet conveying speed. Firstly, the sheet S12 which is conveyed from the printer main body 1001 starts to be accelerated by the accelerating roller 321 at the accelerating point where the rear end thereof departs from the discharge roller 119. Accordingly, the sheet conveying speed is accelerated from V0 to V1.

On the other hand, the back cover S13 which is waiting at the stop position starts to be conveyed at the sheet conveying speed V1 so that the time interval is to be t0 (see FIG. 5B). The sucking of the front cover S14 of the next bundle cannot be started until the back cover S13 is conveyed because of the interference by the rear end of the back cover S13. Therefore, the front cover S14 starts to be conveyed when sucking time t1 passes after the back cover S13 starts to be conveyed.

When the back cover S13 and the front cover S14 of the next bundle are inserted after the sheet S12, the time interval between the accelerated sheet S12 and the back cover S13 and the time interval between the back cover S13 and the front cover S14 of the next bundle become t4 which is longer than that of the sheet S12 in the case without being accelerated.

By accelerating the sheet conveying speed so as to keep the time interval long, the sucking time t1 is sufficiently ensured and the waiting time t5 can be ensured to prepare for occurring of an unexpected problem at the time of the separating and feeding which causes delay to the sheet conveying. Accordingly, by ensuring the waiting time t5 as described above, the inserting of the front cover etc. can be reliably performed.

Here, the time interval between the rear end of the preceding sheet and the top end of the following sheet can be prolonged by accelerating the sheet conveying speed to V1 compared to the time interval t3 in the case that the sheet conveying speed is V0. Accordingly, the interference between the sheets which is apt to occur at the time of merging can be prevented.

As described above, in the present embodiment, the sheet conveying speed of the sheet from the image forming portion 1005 is accelerated before the insertion sheet is inserted. Further, the sheet conveying speed of the sheet from the image forming portion 1005 and the insertion sheet is decelerated before arriving at the sheet processing apparatus. Consequently, the insertion sheet can be inserted without decreasing the productivity. Further, with this structure, the sheet transferring speed among the printer main body 1001, the inserter 1003 and the finisher 1006 can be approximately the same. Therefore, the control as a system can be simplified.

Here, in the present embodiment, the retard type is adopted as the separating/feeding mechanism of the printer main body 1001 and the air separation type is adopted as that of the inserter 1003. However, not limited to the above, the present invention can adopt other types.

Further, in the above description, the inserter 1003 is controlled by the inserter control portion 131. However, not limited to the above, the inserter 1003 can be controlled by the main body controller 130.

Furthermore, in the above description, the conveying path is arranged in the inserter. However, the conveying path is to be arranged in the printer main body in the case that the inserter is arranged in the printer main body, for example. Moreover, the conveying path is also to be arranged in the printer main body in the case that the insertion sheet from the inserter is inserted within the printer main body and conveyed thereafter.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-035058, filed Feb. 15, 2008, which is hereby incorporated by reference herein in its entirety.

What is claimed is:

1. An image forming apparatus, comprising:

an image forming apparatus main body;

a sheet inserting device which is arranged to be detachable from the image forming apparatus main body and which inserts an insertion sheet between sheets on which images are formed;

a post-processing device which performs a post-process to the sheets on which the images are formed at the image forming apparatus main body and the insertion sheet;

a sheet conveying path which is arranged at the sheet inserting device and which conveys the sheets on which the images are formed at the image forming apparatus main body and the insertion sheet to the post-processing device;

a sheet conveying portion which is arranged at the sheet conveying path and which conveys the sheets being capable of accelerating and decelerating; and a control portion which controls operation of the sheet conveying portion, wherein the control portion performs the control of accelerating sheet conveying speed of the sheets from the image forming apparatus main body from a predetermined conveying speed at the sheet conveying path, inserting the insertion sheet so as to follow a preceding sheet which is accelerated, and conveying the sheets from the image forming apparatus main body and the insertion sheet to the post-processing device after being decelerated to the predetermined conveying speed.

2. The image forming apparatus according to claim 1, further comprising:

an insertion sheet accommodating portion which is arranged at the sheet inserting device and which accommodates the insertion sheets in a piled state; and a delivering portion which is arranged at the sheet inserting device and which delivers the sheet accommodated in the insertion sheet accommodating portion to the sheet conveying path, wherein the control portion performs the control of accelerating the sheet conveying speed of the sheets from the image forming apparatus main body from the predetermined conveying speed to a second predetermined conveying speed at the sheet conveying path, and delivering the insertion sheet by the delivering portion to the sheet conveying path at the second predetermined conveying speed so as to follow a preceding sheet which is accelerated to the second predetermined conveying speed.

3. The image forming apparatus according to claim 2, wherein the sheet conveying portion comprises a first sheet conveying member which is capable of conveying the sheet at any of the predetermined conveying speed and the second predetermined conveying speed, and a second sheet conveying member which is arranged at the downstream side of the sheet conveying direction of the first sheet conveying member and which is capable of conveying the sheet at any of the predetermined conveying speed and the second predetermined conveying speed, both of the sheet conveying members being arranged so that the sheet is conveyed to be transferred from the first sheet conveying member to the second sheet conveying member; and wherein the control portion controls driving of the first sheet conveying member so that the sheet conveying speed of the sheet from the image forming apparatus main body is accelerated to the second predetermined conveying speed before the insertion sheet following the accelerated sheet is delivered to the sheet conveying path, and controls driving of the second sheet conveying member so that the sheet conveying speed of the sheet from the image forming apparatus main body and the insertion sheet delivered from the delivering portion is decelerated to the predetermined conveying speed before the sheet from the image forming apparatus main body and the insertion sheet respectively arrive at the post-processing device.

4. The image forming apparatus according to claim 3, wherein the first sheet conveying member is arranged at the sheet conveying path at the downstream side of the sheet conveying direction of a merging point to which the insertion sheet from the sheet delivering portion is delivered.

5. The image forming apparatus according to claim 1, wherein the sheet inserting device comprises an insertion sheet accommodating portion which accommodates the insertion sheet, an insertion sheet feeding portion which feeds the insertion sheet from the insertion sheet accommodating portion, and an insertion sheet conveying path in which the insertion sheet fed by the insertion sheet feeding portion is conveyed so as to merge with the sheet conveying path at a merging point; and wherein the control portion controls the sheet feeding portion so as to temporarily stop the insertion sheet from the sheet accommodating portion at the position on the insertion sheet conveying path before the merging point to merging of the insertion sheet to the sheet conveying path.

6. The image forming apparatus according to claim 1, wherein the image forming apparatus main body and the post-processing device are capable of being directly connected while the sheet inserting device is detached.

7. A sheet inserting device which is capable of attaching to and detaching from an image forming apparatus main body and which inserts an insertion sheet between sheets on which images are formed at the image forming apparatus main body and discharges the image formed sheets and the insertion sheet, comprising:

a sheet conveying path which conveys the sheets on which the images are formed at the image forming apparatus main body and the insertion sheet; and a sheet conveying portion which is arranged at the sheet conveying path and which conveys the sheets being capable of accelerating and decelerating, wherein sheet conveying speed of the sheets from the image forming apparatus main body is accelerated from a predetermined conveying speed at the sheet conveying path, the insertion sheet is inserted so as to follow a preceding sheet which is accelerated, and the sheets from the image forming apparatus main body and the insertion sheet are discharged after being decelerated to the predetermined conveying speed.

8. The sheet inserting device according to claim 7, further comprising:

an insertion sheet accommodating portion which accommodates the insertion sheets in a piled state; and a delivering portion which delivers the sheet accommodated in the insertion sheet accommodating portion to the sheet conveying path, wherein the sheet conveying speed of the sheets from the image forming apparatus main body is accelerated from the predetermined conveying speed to a second predetermined conveying speed at the sheet conveying path, and the insertion sheet is delivered by the delivering portion to the sheet conveying path at the second predetermined conveying speed so as to follow a preceding sheet which is accelerated to the second predetermined conveying speed.

9. The sheet inserting device according to claim 8, wherein the sheet conveying portion comprises a first sheet conveying member which is capable of conveying the sheet at any of the predetermined conveying speed and the second predetermined conveying speed, and a second sheet conveying member which is arranged at the downstream side of the sheet conveying direction of the first sheet conveying member and which is capable of conveying the sheet at any of the predetermined conveying speed and the second predetermined conveying speed, both of the sheet conveying members being arranged so that the sheet is conveyed to be transferred from the first sheet conveying member to the second sheet conveying member; and wherein the sheet conveying speed of the sheet from the image forming apparatus main body is accelerated to the second predetermined conveying speed before the insertion sheet following the accelerated sheet is delivered to the sheet conveying path, and the sheet conveying speed of the sheet from the image forming apparatus main body and the insertion sheet delivered from the delivering portion is decelerated to the predetermined conveying speed before being discharged.

10. The sheet inserting device according to claim 9, wherein the first sheet conveying member is arranged at the sheet conveying path at the downstream side of the sheet conveying direction of a merging point to which the insertion sheet from the sheet delivering portion is delivered.

11. The sheet inserting device according to claim 7, further comprising:

an insertion sheet accommodating portion which accommodates the insertion sheet;

an insertion sheet feeding portion which feeds the insertion sheet from the insertion sheet accommodating portion; and an insertion sheet conveying path in which the insertion sheet fed by the insertion sheet feeding portion is conveyed so as to merge with the sheet conveying path at a merging point;

wherein the control portion controls the sheet feeding portion so as to temporarily stop the insertion sheet from the sheet accommodating portion at the position on the insertion sheet conveying path before the merging point to merging of the insertion sheet to the sheet conveying path.

12. The image forming apparatus according to claim 1, wherein a post-processing device which performs a post-process to the sheets and the insertion sheet discharged from the sheet conveying path of the sheet inserting device is capable of being attached to the sheet inserting device.

* * * * *